US012716617B2

(12) United States Patent
Boyd et al.

(10) Patent No.: US 12,716,617 B2
(45) Date of Patent: Aug. 25, 2026

(54) FURNACE CONTROL SYSTEMS AND METHODS

(71) Applicant: Johnson Controls Tyco IP Holdings LLP, Milwaukee, WI (US)

(72) Inventors: Andrew Michael Boyd, Wichita, KS (US); Rakesh Mathew, Wichita, KS (US); Damion Marcel Taylor Cave, Bel Aire, KS (US)

(73) Assignee: Johnson Controls Light Commercial IP GmbH, Shaffhausen (CH)

( * ) Notice: Subject to any disclaimer, the term of this patent is extended or adjusted under 35 U.S.C. 154(b) by 505 days.

(21) Appl. No.: 18/227,190

(22) Filed: Jul. 27, 2023

(65) Prior Publication Data

US 2024/0035707 A1 Feb. 1, 2024

Related U.S. Application Data

(60) Provisional application No. 63/393,514, filed on Jul. 29, 2022.

(51) Int. Cl.

| | |
|---|---|
| ***F24H 15/421*** | (2022.01) |
| ***F24D 19/10*** | (2006.01) |
| ***F24H 15/204*** | (2022.01) |
| ***F24H 15/36*** | (2022.01) |

(52) U.S. Cl.

CPC ..... *F24H 15/421* (2022.01); *F24D 19/1084* (2013.01); *F24H 15/204* (2022.01); *F24H 15/36* (2022.01)

(58) Field of Classification Search

CPC ..... F24H 15/421; F24H 15/204; F24H 15/36; F24H 3/065; F24H 9/2085; F24D 19/1084

See application file for complete search history.

(56) References Cited

U.S. PATENT DOCUMENTS

| | | | | |
|---|---|---|---|---|
| 4,667,874 | A * | 5/1987 | Johnson | F23N 5/203 236/46 E |
| 8,123,518 | B2 | 2/2012 | Nordberg et al. | |
| 10,254,008 | B2 | 4/2019 | Thompson | |
| 2010/0009302 | A1* | 1/2010 | Nordberg | F23N 1/02 431/12 |
| 2011/0137467 | A1* | 6/2011 | Leen | F24F 11/30 236/51 |
| 2011/0174201 | A1* | 7/2011 | Kowald | F23N 5/203 126/116 A |
| 2020/0348087 | A1* | 11/2020 | Wilson | F24F 11/75 |

* cited by examiner

*Primary Examiner* — Kidest Worku
(74) *Attorney, Agent, or Firm* — Jeremy Hargis

(57) ABSTRACT

A furnace system for a heating, ventilation, and air conditioning (HVAC) system includes a furnace controller configured to determine a rolling average furnace run time of the furnace system based on a plurality of previous run cycles of the furnace system. The furnace controller is configured to segment the rolling average furnace run time into a plurality of operational time periods, wherein each operational time period is associated with a distinct fire rate of a plurality of distinct fire rates the furnace system. The furnace controller is also configured to operate the furnace system to sequentially implement the plurality of distinct fire rates associated with the plurality of operational time periods.

19 Claims, 8 Drawing Sheets

FURNACE CONTROL SYSTEMS AND METHODS

CROSS-REFERENCE TO RELATED APPLICATIONS

This application claims priority from and the benefit of U.S. Provisional Application No. 63/393,514, entitled "FURNACE CONTROL SYSTEMS AND METHODS," filed Jul. 29, 2022, which is herein incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are utilized in residential, commercial, and industrial environments to control environmental properties, such as temperature, humidity, and/or air quality, for occupants of the respective environments. The HVAC system may regulate the environmental properties through delivery of a conditioned air flow to the environment. For example, the HVAC system often includes a furnace system that may be used to heat an air flow supplied to an air distribution system of the building. Such furnace systems may typically include a burner assembly and a heat exchanger that cooperate to produce heated supply air, which may be directed through the air distribution system to heat a room or other space within the building. Unfortunately, conventional furnace systems may be unable or ill-equipped to effectively regulate generation and/or output of the heated supply air in a manner that achieves desired climate parameters in the room or other space serviced by the HVAC system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a furnace system for a heating, ventilation, and air conditioning (HVAC) system. The furnace system includes a furnace controller configured to determine a rolling average furnace run time of the furnace system based on a plurality of previous run cycles of the furnace system. The furnace controller is configured to segment the rolling average furnace run time into a plurality of operational time periods, wherein each operational time period is associated with a distinct fire rate of a plurality of distinct fire rates the furnace system. The furnace controller is also configured to operate the furnace system to sequentially implement the plurality of distinct fire rates associated with the plurality of operational time periods.

The present disclosure also relates to a furnace controller for a furnace system. The furnace controller is configured to initiate operation of a furnace system based on receipt of a call for heating, determine that a communication link between the furnace controller and a sensor is severed, and, based on determination of severance of the communication link, operate the furnace system in accordance with a segmented operational control scheme.

The present disclosure also relates to a non-transitory, computer-readable medium comprising instructions that, when executed by a processor, are configured to cause the processor to determine a rolling average furnace run time of a furnace system based on a plurality of previous run cycles of the furnace system. The instructions, when executed, are configured to further cause the processor to segment the rolling average furnace run time into a plurality of operational time periods corresponding to a plurality of distinct fire rates of the furnace system and operate the furnace system to sequentially implement the plurality of distinct fire rates corresponding to the plurality of operational time periods.

BRIEF DESCRIPTION OF THE DRAWINGS

Various aspects of this disclosure may be better understood upon reading the following detailed description and upon reference to the drawings in which.

DETAILED DESCRIPTION

Figure 1:
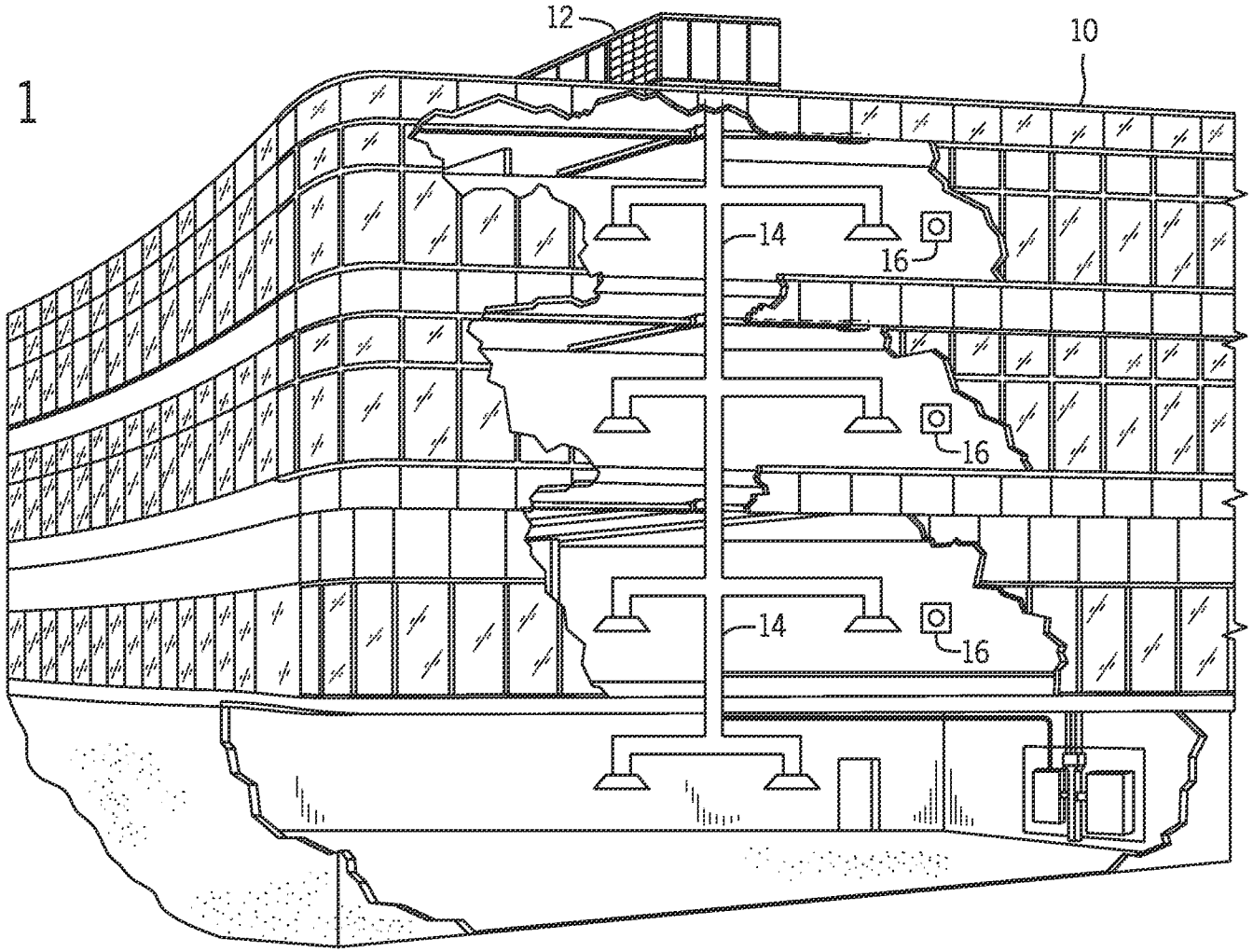
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to convey that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to convey that the given feature is within +/−5%, within +/−4%, within +/−3%, within +/−2%, within +/−1%, or even closer, to having the described nature, such as being parallel to another feature, being perpendicular to another feature, and so forth. Mathematical terms, such as "parallel" and "perpendicular," should not be rigidly interpreted in a strict mathematical sense, but should instead be interpreted as one of ordinary skill in the art would interpret such terms. For example, one of ordinary skill in the art would understand that two lines that are substantially parallel to each other are parallel to a substantial degree, but may have minor deviation from exactly parallel.

As briefly discussed above, a heating, ventilation, and/or air conditioning (HVAC) system may be used to thermally regulate a space within a building, home, or other suitable structure. For example, the HVAC system may include a furnace system that enables the HVAC system to supply heated air to rooms or zones within a building or other suitable structure serviced by the HVAC system. Typical furnace systems include one or more burner assemblies and a heat exchanger that cooperate to produce the heated supply air. For example, furnace systems may operate by burning or combusting a mixture of air and fuel in the burner assemblies to produce hot combustion products that are directed through tubes or piping of the heat exchanger. A blower may direct an air flow across the tubes or piping of the heat exchanger, thereby enabling the air flow to absorb thermal energy from the combustion products. In this manner, heated supply air may be discharged from the furnace system and directed to the rooms or zones of the building. For example, the blower may direct the heated supply air through an air distribution system of the building, such as through a system of ductwork and/or suitable conduits, and thereby supply the heated air to rooms or zones of the building in response to a call for heating.

Generally, the furnace system includes a controller (e.g., control circuitry, a processor configured to execute instructions stored on memory) that is configured to control, regulate, and/or otherwise adjust operation of the furnace system. The controller may operate the furnace system based on feedback from an external source or device (e.g., a thermostat, such as a communicating thermostat or a conventional thermostat; a temperature sensor, such as a return air temperature sensor) that may be configured to monitor a temperature of return air received by the furnace system, a temperature of heated supply air output by the furnace system, and/or a temperature of the space to be conditioned by the furnace system. For example, the controller may control a fire rate (e.g., staging) of the furnace system based on the temperature feedback to adjust a heat output of the furnace system. In this way, the controller may control the furnace system in response to a demand (e.g., load) of the space to be conditioned by the furnace system. In some embodiments, a communication channel (e.g., a communication link) between the controller and the external device may become interrupted (e.g., permanently interrupted, temporarily interrupted), such that the controller does not receive the temperature feedback from the external device. As a result, the controller may be unable to adjust the fire rate of the furnace system in a manner that achieves a desired target temperature within the space to be conditioned and/or may be unable to efficiently operate the furnace system to achieve the desired target temperature.

It is now recognized that it is desirable to enable fire rate adjustment and/or staging of the furnace system during operational periods in which the controller of the furnace system does not receive temperature feedback or other suitable feedback from an external source (e.g., a thermostat, a temperature sensor), for example. In accordance with the present techniques, the furnace system may continue to adjust a heat output of the furnace system, without information (e.g., temperature data) typically received from the external source, to operate the furnace system in a manner that adequately and/or more efficiently achieves a desired target temperate within the space to be conditioned. Accordingly, embodiments of the present disclosure are directed toward an improved furnace controller that is configured to adjust a fire rate or other staging of a furnace system independently of temperature feedback that may be typically expected from an external source (e.g., a thermostat, a temperature sensor). That is, embodiments of the furnace controller discussed herein are configured to adjust a fire rate of the furnace system, and thus a rate of heat output of the furnace system, in a manner that enables desired climate parameters within a space to be more efficiently achieved without utilizing temperate feedback from the external source or device. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
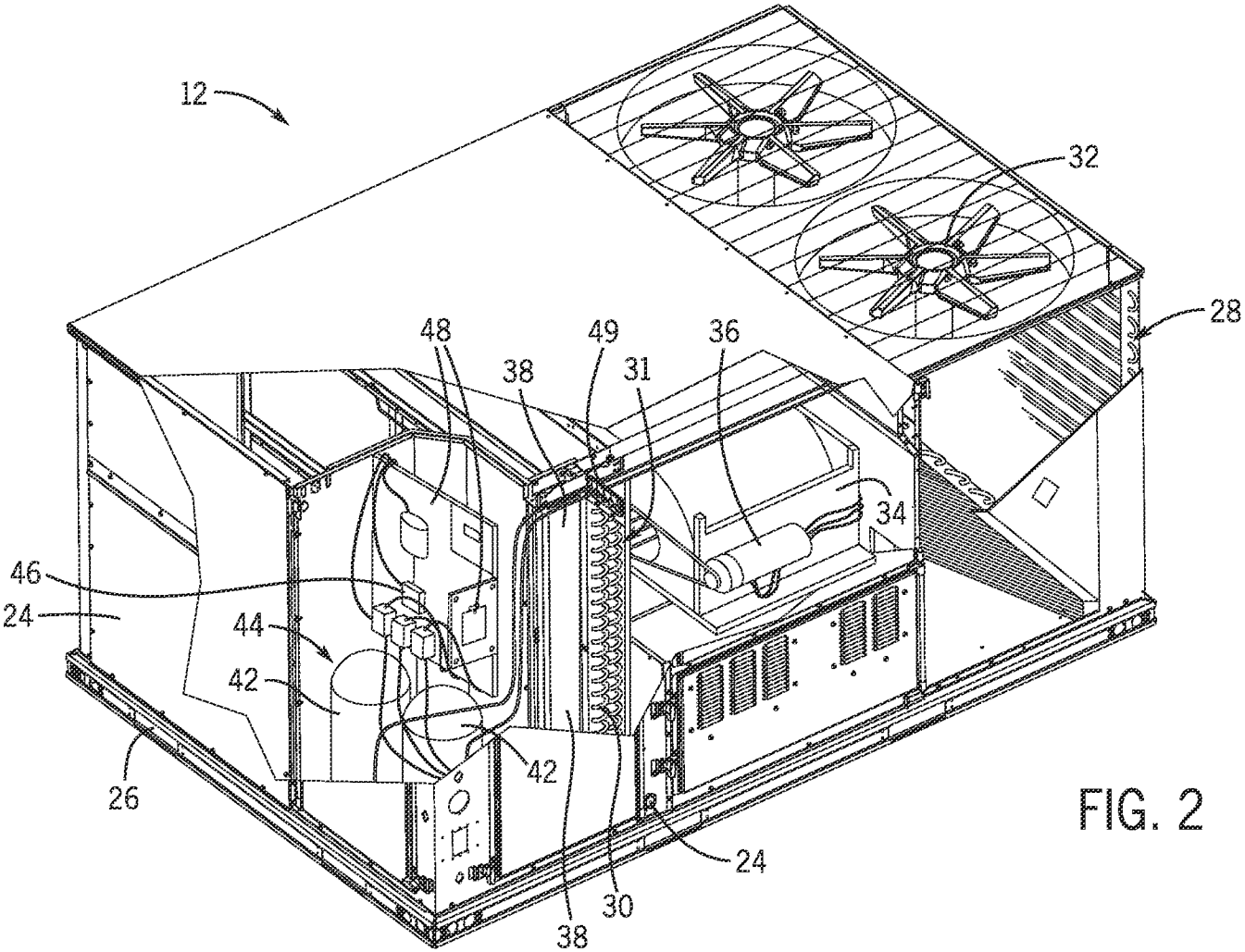
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
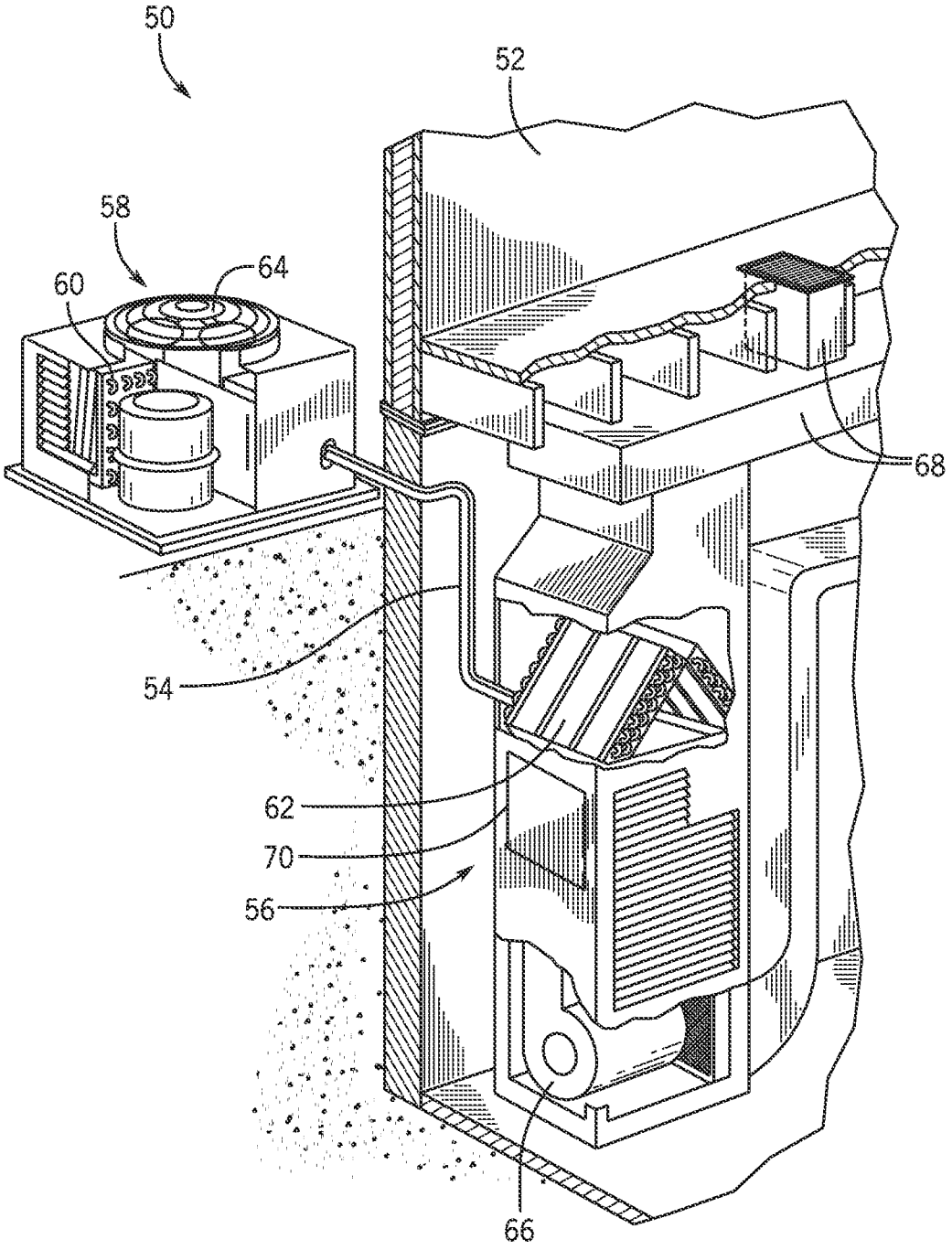
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
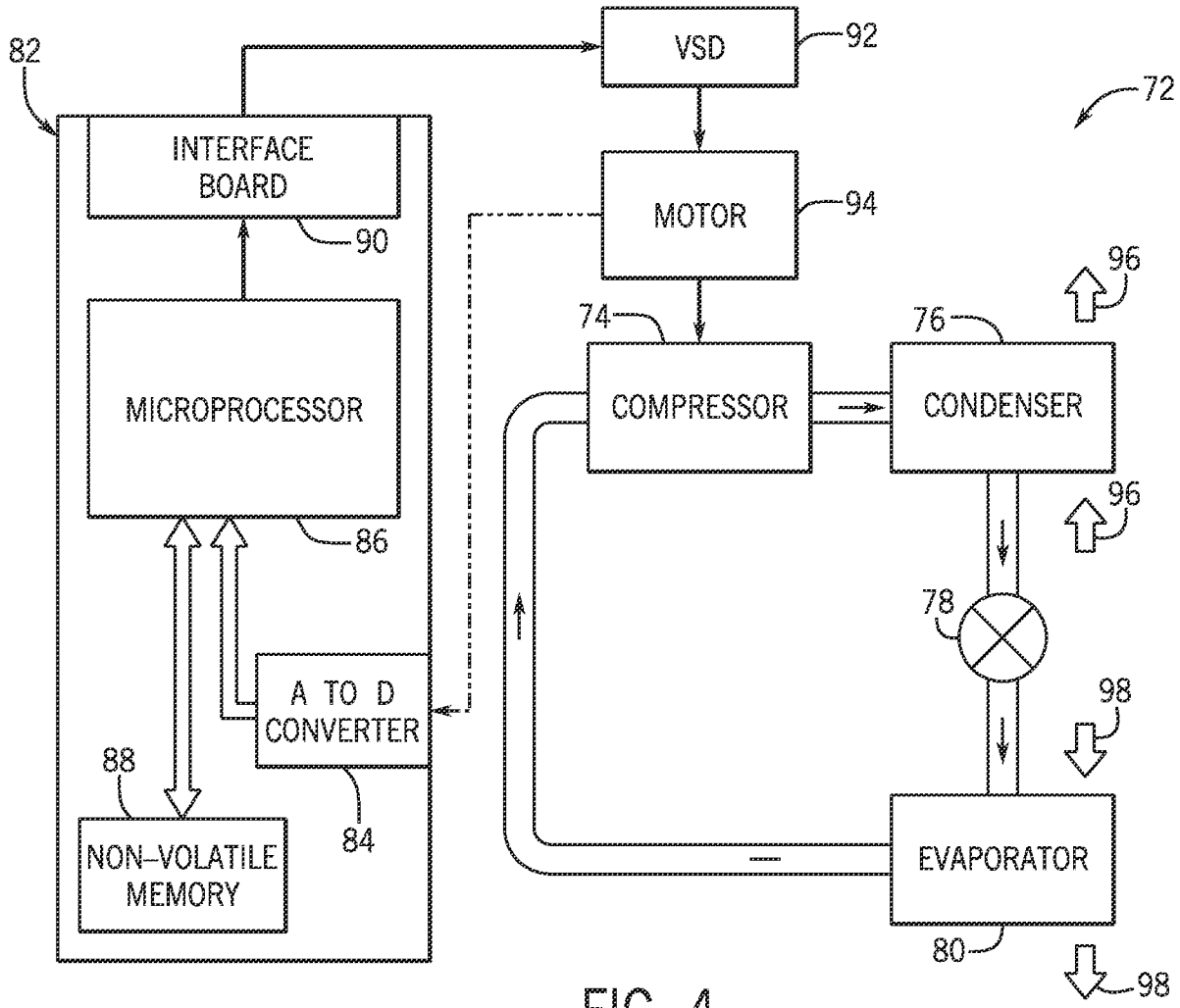
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
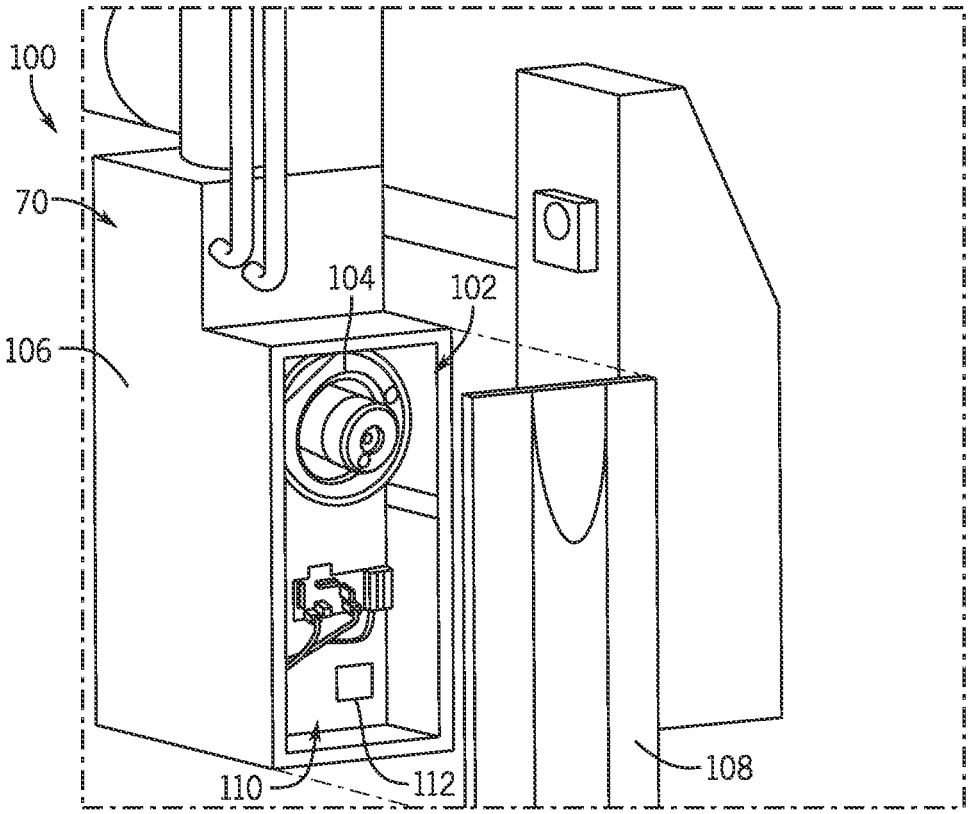
FIG. 5 is a perspective view of an embodiment of a portion of an HVAC system having a furnace system, in accordance with an aspect of the present disclosure.

FIG. 5 is a perspective view of an embodiment of a portion of an HVAC system 100 that includes an embodiment of the furnace system 70. The furnace system 70 includes a blower assembly 102 having a blower 104, such as the blower 66, which may be configured to direct air across heat exchanger components (e.g., heat transfer tubes) of the furnace system 70 and through ductwork (e.g., the ductwork 68) of a building or other structure serviced by the HVAC system 100. In the illustrated embodiment, the furnace system 70 includes an enclosure 106 (e.g., an air handler enclosure) configured to house components of the furnace system 70, such as the blower 104 and the heat transfer tubes of the furnace system 70. The enclosure 106 may include a door 108 or panel that may be moveably (e.g., pivotably, removably, slidingly) coupled to a remainder of the enclosure 106 to expose or occlude an opening 110 of the enclosure 106. The furnace system 70 includes a furnace controller 112 that is configured to operate the furnace system 70 in accordance with the techniques discussed herein. It should be appreciated that the presently disclosed techniques may be incorporated with other furnace systems or components, such as a furnace system of air handling unit, a rooftop unit, or other HVAC system, an electric furnace, or other furnace configured to operate in different stages.

Figure 6:
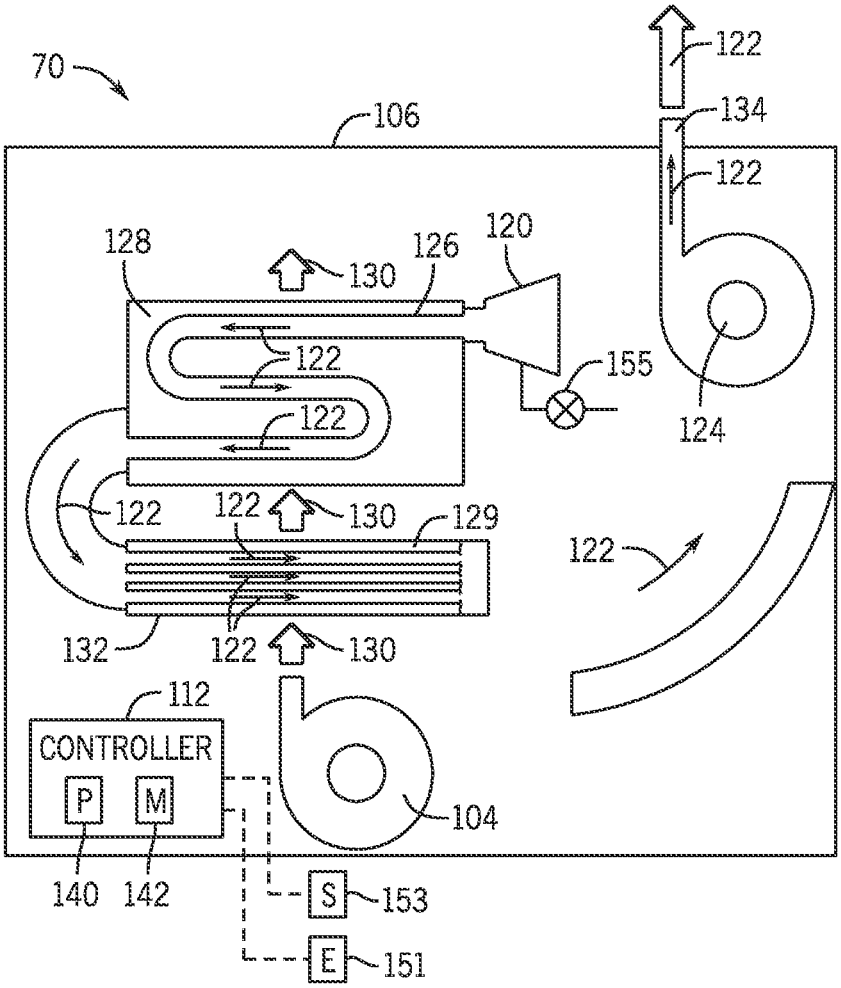
FIG. 6 is a schematic of an embodiment of a furnace system, in accordance with an aspect of the present disclosure.

FIG. 6 is a schematic of an embodiment of the furnace system 70 having the furnace controller 112. In the illustrated embodiment, the furnace system 70 includes a burner 120 (e.g., one or more burner assemblies) configured to combust a fuel to generate combustion products 122. A draft inducer blower 124 is configured to draw the combustion products 122 through one or more tubes 126 of a first heat exchanger 128 and through one or more additional tubes 129 of a second heat exchanger 132 (e.g., a condensing heat exchanger). The blower 104 is configured to direct a flow of supply air 130 across the tubes 126 of the first heat exchanger 128 and the additional tubes 129 of the second heat exchanger 132 to enable the supply air 130 to absorb thermal energy from the heated combustion products 122 directed through the first and second heat exchangers 128, 132. As such, the blower 104 may deliver heated supply air 130 to a space within a building or other structure serviced by the HVAC system 100. The draft inducer blower 124 may discharge the combustion products 122 from the furnace system 70 via an exhaust vent 134. It should be understood that, in some embodiments, the first heat exchanger 128 or the second heat exchanger 132 may be omitted from the furnace system 70. Indeed, many different embodiments of the furnace system 70 are envisioned, and the illustrated embodiment of the furnace system 70 of FIG. 6 is merely intended to provide context for the following discussion.

As discussed above, the furnace controller 112 is configured to control the furnace system 70 in accordance with the techniques discussed herein. The furnace controller 112 includes processing circuitry 140 (e.g., control circuitry, a processor), such as a microprocessor, which may execute software (e.g., instructions stored on a memory) for controlling the components of the furnace system 70 and/or the HVAC system 100. The processing circuitry 140 may include multiple microprocessors, one or more "general-purpose" microprocessors, one or more special-purpose microprocessors, and/or one or more application specific integrated circuits (ASICS), or some combination thereof. For example, the processing circuitry 140 may include one or more reduced instruction set (RISC) processors.

The furnace controller 112 may also include a memory device 142 (e.g., a memory) that may store information, such as instructions, control software, executable-instructions, look up tables, configuration data, etc. The memory device 142 may include a volatile memory, such as random access memory (RAM), and/or a nonvolatile memory, such as read-only memory (ROM). The memory device 142 may store a variety of information and may be used for various purposes. For example, the memory device 142 may store processor-executable instructions including firmware or software for the processing circuitry 140 to execute, such as instructions for controlling components of the furnace system 70 and/or of the HVAC system 100. In some embodiments, the memory device 142 is a tangible, non-transitory, machine-readable-medium that may store machine-readable instructions for the processing circuitry 140 to execute. The memory device 142 may include ROM, flash memory, a hard drive, or any other suitable optical, magnetic, or solid-state storage medium, or a combination thereof. The memory device 142 may store data, instructions, and any other suitable data (e.g., data received from one or more sensors of the HVAC system 100).

Figure 7:
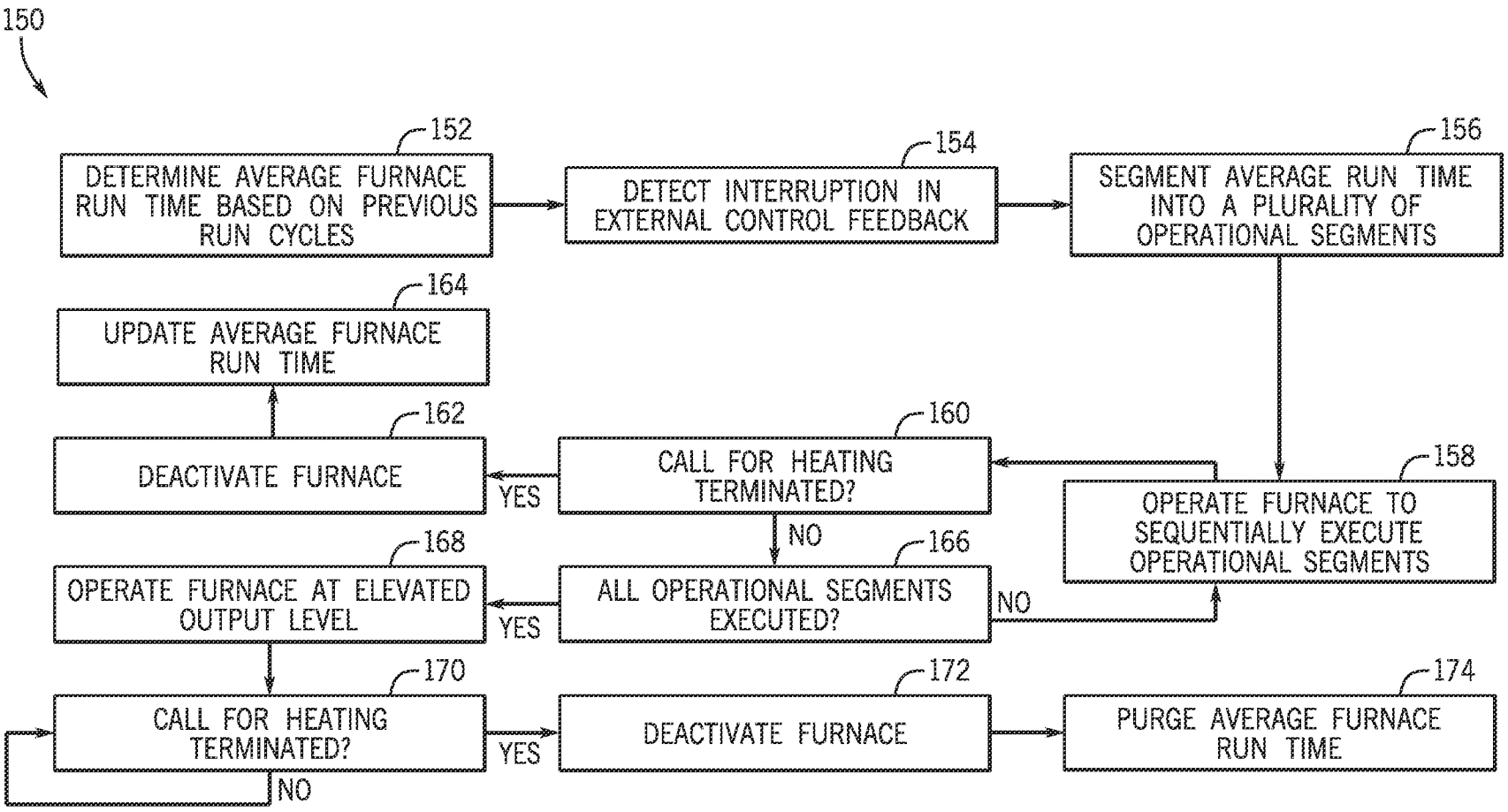
FIG. 7 is a flow diagram of an embodiment of a process for operating a furnace system, in accordance with an aspect of the present disclosure.

To facilitate the following discussion, FIG. 7 is flow diagram of an embodiment of a process 150 for controlling the furnace system 70 in accordance with the presently disclosed techniques. FIG. 7 will be referenced concurrently with FIGS. and 6 throughout the following discussion. It should be noted that the steps of the process 150 discussed below may be performed in any suitable order and are not limited to the order shown in the illustrated embodiment of FIG. 7. Moreover, it should be noted that additional steps of the process 150 may be performed, and certain steps of the process 150 may be omitted. In some embodiments, the process 150 may be executed by the processing circuitry 140 of the furnace controller 112 and/or any other suitable processing circuitry of the HVAC system 100. The process 150 may be stored (e.g., as executable instructions) on, for example, the memory device 142 of the furnace controller 112.

The process 150 may begin with determining an average furnace run time (e.g., a rolling average furnace run time) of the furnace system 70 (e.g., based on previous run cycles of the furnace system 70), as indicated by block 152. For example, in some embodiments, the furnace controller 112 may receive feedback (e.g., data) from the control device 16 (e.g., a thermostat, another external device) indicative of a call for heating. In response to receiving the call for heating, the furnace controller 112 may initiate operation of the furnace system 70 to output a flow of heated air in accordance with the techniques discussed above. The furnace controller 112 may continue to operate the furnace system 70 until the furnace controller 112 receives feedback (e.g., data) from the control device 16 that the call for heating has been satisfied. That is, the furnace controller 112 may operate the furnace system 70 until the furnace controller 112 receives instruction or other input from the control device 16 to suspend operation of the furnace system 70. In this way, the furnace controller 112 may operate the furnace system 70 for a plurality of discrete run cycles. As used herein, a "run cycle" of the furnace system 70 may correspond to a time interval beginning at initialization of furnace system 70 operation (e.g., in response to a received call for heating) and ending at suspension of furnace system 70 operation (e.g., in response to satisfaction of the received call for heating). That is, the furnace controller 112 may determine that a run cycle of the furnace system 70 has initiated in response to receiving a call for heating (e.g., from the control device 16) and may determine that the run cycle of the furnace system 70 has terminated in response to receiving an indication (e.g., from the control device 16) that the call for heating has been satisfied or suspended. The furnace controller 112 may iteratively execute this process to determine (e.g., identify) individual run cycles of the furnace system 70 and/or to log (e.g., store) data indicative of multiple discrete run cycles of the furnace system 70, as discussed below.

The furnace controller 112 may be configured to determine (e.g., via a timer, via analysis of stored data on the memory device 142) a run cycle time (e.g., a furnace run time) for each of one or more run cycles (e.g., previous run cycles) of the furnace system 70 and to store the run cycle times on the memory device 142. For example, for a particular run cycle, the furnace controller 112 may monitor (e.g., determine, log, record) a time period that elapses between when the furnace controller 112 receives a call for heating (e.g., from the control device 16) and when the furnace controller 112 receives an indication (e.g., from the control device 16) that the call for heating has been satisfied or suspended, and may store this time period (e.g., on the memory device 142) as the run cycle time for that particular run cycle. The furnace controller 112 may utilize the logged run cycle times to determine a rolling average run cycle time for the furnace system 70. The rolling average run cycle time may correspond to an average value of the previously logged run cycle times of the furnace system 70 (e.g., as logged by the furnace controller 112). In some embodiments, the furnace controller 112 may implement a weighted average calculation to determine the rolling average run cycle time of the furnace system 70, such that more recent run cycle times of the furnace system 70 are given a greater weight (e.g., weight percentage) in the determination of the rolling average run cycle time as compared to less recent run cycle times.

In some embodiments, the furnace controller 112 may receive feedback from the control device 16 (e.g., a thermostat, such as a communicating thermostat or a conventional thermostat), a sensor 153 (e.g., a return air temperature sensor, a supply air temperature sensor, a room air temperature sensor), and/or another external device 151 indicative of a temperature of return air received by the furnace system 70 (e.g., from a space conditioned by the HVAC system 100), a temperature of heated supply air output by the furnace system 70, and/or a temperature of the space to be conditioned by the furnace system 70. The sensor 153 may be configured to provide feedback (e.g., to the furnace controller 112) indicative of a parameter (e.g., temperature) of return air received by the furnace system 70 from a conditioned space serviced by the furnace system 70. In some embodiments, the external device 151 may include the control device 16, the sensor 153, or both. The furnace controller 112 may utilize the feedback to control a fire rate (e.g., a distinct fire rate) and/or operating stage of the furnace system 70. As used herein, a "fire rate" of the furnace system 70 may be indicative of an operating capacity of one or more burner assemblies of the furnace system 70. For example, the furnace controller 112 may be configured to send instructions to one or more gas valves 155 of the furnace system 70 to modulate a flow of gas to the one or more burner assemblies (e.g., the burner 120). In this way, the furnace controller 112 may adjust an amount of combustion products generated by the one or more burner assemblies and, thus, adjust a heat transfer rate between a heat exchanger of the furnace system 70 (e.g., a heat exchanger configured to receive the combustion products) and an air flow directed across the heat exchanger (e.g., a return air flow, a supply air flow). The fire rate of the furnace system 70 may therefore correspond to the position(s) of the one or more gas valves 155 of the furnace system 70, as well as to the overall heat output rate of the furnace system 70. It should be appreciated that other components of the furnace system 70 may additionally or alternatively be adjusted (e.g., a speed of the draft inducer blower 124) to effectuate an adjustment in an operating stage and/or fire rate of the furnace system 70.

In some embodiments, a full fire rate of the furnace system 70 may correspond to an operating condition of the furnace system 70 in which the one or more gas valves 155 of the furnace system 70 are in a fully open position, such that a heat output rate of the furnace system 70 is relatively high. A moderate fire rate of the furnace system 70 may correspond to an operating condition of the furnace system 70 in which the one or more gas valves 155 of the furnace system 70 are in a first partially closed position, such that a heat output rate of the furnace system 70 is moderate (e.g., reduced compared to the heat output at the full fire rate). Further, a low fire rate of the furnace system 70 may correspond to an operating condition of the furnace system 70 in which the one or more gas valves 155 of the furnace system 70 are in a second partially closed position (e.g., further closed that the first partially closed position), such that a heat output rate of the furnace system 70 is relatively low (e.g., reduced compared to the heat output at the moderate fire rate). The furnace controller 112 may adjust the fire rate of the furnace system 70 based on feedback from the external device 151 (e.g., the control device 16, the sensor 153) configured to provide data indicative of a temperature of return air received by the furnace system 70, a temperature of heated supply air output by the furnace system 70, and/or a temperature of the space to be conditioned by the furnace system 70. As such, the furnace controller 112 may vary the fire rate based on a load on the furnace system 70, for example. In some embodiments, the furnace controller 112 may be configured to adjust the one or more gas valves 155 to a plurality of discrete positions to achieve a plurality of discrete fire rates for the furnace system 70. For example, the one or more gas valves 155 may be modulating valves configured to adjust between 2, 3, 4, 5, 6, or more than 6 discrete positions (e.g., based on instructions received from the furnace controller 112) to achieve 2, 3, 4, 5, 6, or more than 6 corresponding fire rates of the furnace system 70.

In some embodiments, a communication channel or communication link (e.g., external control feedback) between the furnace controller 112 and the external device 151 (e.g., the control device 16, the sensor 153) may be interrupted. The communication channel or communication link may be a wired or wireless connection configured to typically communicatively couple the furnace controller 112 to the external device 151. The furnace controller 112 may detect an interruption in the external control feedback, as indicated by block 154. That is, the furnace controller 112 may be configured to determine that the wired or wireless communication connection between the furnace controller 112 and the external device 151 is temporarily or permanently severed or suspended. In accordance with the techniques discussed herein, the furnace controller 112 may utilize the previously determined rolling average run cycle time of the furnace system 70 to adjust a fire rate of the furnace system 70 without relying on external control feedback (e.g., temperature feedback) from the external device 151 (e.g., the control device 16, the sensor 153). To this end, the furnace controller 112 may adjust a fire rate of the furnace system 70 (e.g., via adjustment of the one or more gas valves 155) when the wired or wireless communication connection between the furnace controller 112 and the external device 151 is temporarily or permanently severed or suspended.

For example, in response to detecting the interruption in the external control feedback (e.g., data) at block 154, the furnace controller 112 may segment (e.g., divide) the rolling average run cycle time into a plurality of segments to form the basis of a segmented operational control scheme, as indicated by block 156. The furnace controller 112 may associate each of the segments with a particular fire rate of the furnace system 70. As discussed in detail below, in response to receiving a call for heating, the furnace controller 112 may operate the furnace system 70 in accordance with the segmented operational control scheme to adjust a heat output of the furnace system 70 during the call for heating without utilizing feedback (e.g., temperature feedback) from an external source (e.g., the external device 151).

As a non-limiting example, at block 154, the furnace controller 112 may determine that a communication link between the furnace controller 112 and the sensor 153 (e.g., a return air temperature sensor) has been suspended or severed. At block 156 the furnace controller 112 may segment the rolling average furnace run time into four segments (e.g., time segments) of equal or different length. These segments will be referred to herein as a first segment, a second segment, a third segment, and a fourth segment. It should be understood that a cumulative time period of the first, second, third, and fourth segments may correspond to (e.g., equal or approximately equal) the rolling average furnace run time. The furnace controller 112 may associate the first segment with a high fire rate (e.g., a 100% or full fire rate), may associate the second segment with a moderate fire rate (e.g., a 90% fire rate), may associate the third segment with a reduced fire rate (e.g., a 80% fire rate), and may associate the fourth segment with a low fire rate (e.g., a 70% fire rate). In some embodiments, the furnace controller 112 may reduce the fire rate of the furnace system 70 by a predetermined percentage between each of the sequential segments.

It should be understood that, in some embodiments, interruption of the communication link between the furnace controller 112 and the sensor 153 may be indicative of the sensor 153 experiencing a fault condition. For example, in such embodiments, the sensor 153 may be communicatively coupled to the furnace controller 112 but may not transmit feedback (e.g., data) to the furnace controller 112 or may transmit faulty feedback to the furnace controller 112 (e.g., feedback that deviates from an expected operating range for the sensor feedback from the sensor 153). As used herein, interruption of the communication link between the furnace controller 112 and the sensor 153 may be indicative of the furnace controller 112 determining that the sensor 153 is experiencing such a fault condition. In some embodiments, the sensor 153 may be integrated with and/or form a portion of the control device 16 (e.g., a thermostat). In such embodiments, the furnace controller 112 may receive signals from the control device 16 to, for example, initiate operation of the furnace system 70 (e.g., based on receipt of a call for heating) or to terminate operation of the furnace system (e.g., based on receipt of an indication that the call for heating is satisfied), but may not receive signals from the sensor 153 when the sensor 153 experiences a fault condition. That is, when the sensor 153 experiences a fault condition, the furnace controller 112 may maintain a communication link with the control device 16 (e.g., with other components of the control device 16, such as processing circuitry of the control device 16), while a communication link between the furnace controller 112 and the sensor 153 is severed. In other embodiments, the control device 16 and the sensor 153 may be separate components of one another.

In response to receiving a call for heating, the furnace controller 112 may operate the furnace system 70 to sequentially implement the respective fire rates associated with the various segments of the segmented operational control scheme, as indicated by block 158. For example, the furnace controller 112 may operate the furnace system 70 at the high fire rate throughout the duration of the first segment (e.g., first time period), operate the furnace system 70 at the moderate fire rate throughout the duration of the second segment (e.g., second time period), operate the furnace system 70 at the reduced fire rate throughout the duration of the third segment (e.g., third time period), and operate the furnace system 70 at the low fire rate throughout the duration of the fourth segment (e.g., fourth time period). In this way, the furnace controller 112 may sequentially implement the respective fire rates associated with the first, second, third, and/or fourth segments of the segmented operational control scheme. To this end, the furnace controller 112 may adjust the fire rate of the furnace system 70 (e.g., based on the first, second, third, and/or fourth segments), even while the communication link between the furnace controller 112 and the sensor 153 has been suspended or severed. It should be understood that, while the present embodiment describes the furnace controller 112 as operating in accordance with a segmented operational control scheme having four segments, in other embodiments, the segmented operational control scheme may include any suitable quantity of segments. For example, the furnace controller 112 may adjust the segmented operational control scheme to include 2, 3, 4, 5, 6, or more than 6 segments.

During execution of the step at block 158, the furnace controller 112 may continuously or periodically determine whether the call for heating has been terminated (e.g., satisfied), as indicated by block 160. In response to a determination that the call for heating has been terminated (e.g., based on a signal received from the control device 16), the furnace controller 112 may deactivate or suspend operation of the furnace system 70, as indicated by block 162. Further, the furnace controller 112 may update the rolling average furnace run time to include the run cycle time of this most recently terminated run cycle of the furnace system 70, as indicated by block 164.

In response to a determination that the call for heating remains (e.g., has not been terminated or satisfied), the furnace controller 112 may determine whether all operational segments of the segmented operational control scheme have been executed, as indicated by block 166. In response to a determination that all operational segments of the segmented operational control scheme have not yet been executed, the furnace controller 112 may return to block 158. In response to a determination that all operational segments of the segmented operational control scheme have been executed and the call for heating nevertheless remains (e.g., for a predetermined amount of time after execution of all operational segments), the furnace controller 112 may operate the furnace system 70 at an elevated output level, as indicated by block 168. For example, the furnace controller 112 may operate the furnace system 70 at the high fire rate until the call for heating has been terminated or satisfied, as indicated by block 170.

In response to a determination that the call for heating has been terminated (e.g., based on a signal received from the control device 16) at block 170, the furnace controller 112 may deactivate the furnace system 70, as indicated by block 172. Moreover, in some embodiments, the furnace controller 112 may purge the rolling average furnace run time, as indicated by block 174. That is, the furnace controller 112 may replace an index in the memory device 142 corresponding to the rolling average furnace run time with a placeholder value, for example. The placeholder value may subsequently be replaced in accordance with the techniques discussed below.

Figure 8:
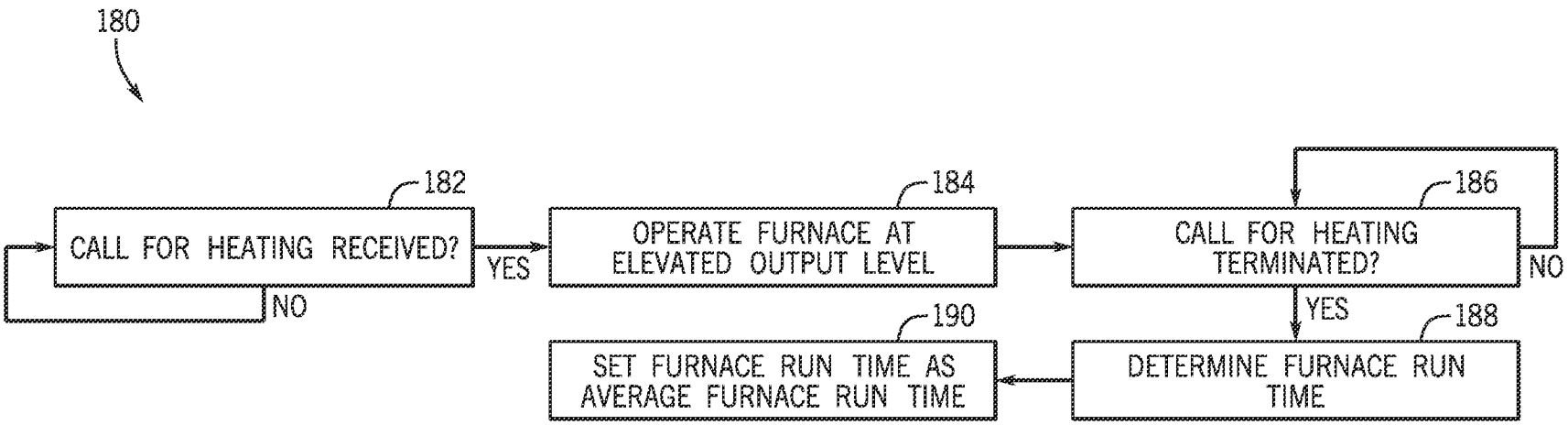
FIG. 8 is a flow diagram of an embodiment of a process for operating a furnace system, in accordance with an aspect of the present disclosure.

FIG. 8 is flow diagram of an embodiment of a process 180 for re-setting the rolling average furnace run time upon execution of the block 174 of FIG. 7. It should be noted that the steps of the process 180 discussed below may be performed in any suitable order and are not limited to the order shown in the illustrated embodiment of FIG. 8. Moreover, it should be noted that additional steps may be included in the process 180 and may be performed, and certain steps of the process 180 may be omitted. In some embodiments, the process 180 may be executed by the processing circuitry 140 of the furnace controller 112 and/or any other suitable processing circuitry of the HVAC system 100. The process 180 may be stored (e.g., as executable instructions) on, for example, the memory device 142 of the furnace controller 112.

The process may begin with receiving a call for heating, as indicated by block 182. For example, the furnace controller 112 may receive a call (e.g., from the control device 16) to operate the furnace system 70 to provide heated supply air to a space serviced by the furnace system 70. In response to receiving the call for heating, the furnace controller 112 may operate the furnace system 70 at the elevated output level (e.g., the high fire rate), as indicated by block 184, until the call for heating is terminated, as indicated by block 186. That is, in some embodiments, the furnace controller 70 may adjust the one or more gas valves 155 to operate the furnace system 70 at the elevated output level until the furnace controller 112 receives an indication (e.g., a signal from the control device 16) that the call for heating has been satisfied or suspended.

In response to receiving an indication that the call for heating has been terminated (e.g., satisfied, suspended), the furnace controller 112 may determine a run cycle time for the furnace system 70 (e.g., a time period from initiation to termination of the most recent call for heating and/or furnace system 70 operation), as indicated by block 188. As indicated by block 190, the furnace controller 112 may set the rolling furnace average run time to correspond to the run cycle time determined at block 188. Upon execution of the process 180, and in response to a subsequent call for heating, the furnace controller 112 may re-execute the process 150 of FIG. 7 in accordance with the techniques discussed above.

As set forth above, embodiments of the present disclosure may provide one or more technical effects useful for enabling fire rate and/or staging adjustment of a furnace system during operational periods in which a furnace controller of the furnace system does not receive temperature feedback from an external source, such as a thermostat and/or a temperature sensor. The furnace controller disclosed herein may continue to adjust a heat output of the furnace system, without information (e.g., temperature data) typically received from the external source, to operate the furnace system in a manner that adequately and/or more efficiently achieves a desired target temperate within the space to be conditioned. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A furnace system for a heating, ventilation, and air conditioning (HVAC) system, comprising:

a furnace controller configured to:

determine a rolling average furnace run time of the furnace system based on a plurality of previous run cycles of the furnace system;

segment the rolling average furnace run time into a plurality of operational time periods, wherein each operational time period is associated with a distinct fire rate of a plurality of distinct fire rates the furnace system; and operate the furnace system to sequentially implement the plurality of distinct fire rates associated with the plurality of operational time periods.

2. The furnace system of claim 1, wherein the furnace controller is configured to operate the furnace system to sequentially implement the plurality of distinct fire rates based on a determination that a communication link between the furnace controller and a sensor of the furnace system is severed.

3. The furnace system of claim 2, comprising the sensor, wherein the sensor is configured to provide feedback indicative of a parameter of an air flow.

4. The furnace system of claim 3, wherein the air flow comprises a return air flow received by the furnace system from a space serviced by the furnace system, and wherein the parameter comprises a temperature of the return air flow.

5. The furnace system of claim 3, comprising a thermostat configured to provide the furnace controller with instructions to initiate operation of the furnace system, to terminate operation of the furnace system, or both.

6. The furnace system of claim 1, wherein the furnace controller is configured to:

receive a call for beating;

determine a run cycle time of the furnace system based on termination of the call for heating; and update the rolling average furnace run time of the furnace system based on the run cycle time.

7. The furnace system of claim 1, wherein the furnace controller is configured to:

operate the furnace system for the plurality of operational time periods to sequentially implement the plurality of distinct fire rates;

determine whether a call for heating remains present upon lapse of the plurality of operational time periods; and based on a determination that the call for heating remains present upon lapse of the plurality of operational time periods, operate the furnace system at an elevated output level.

8. The furnace system of claim 7, wherein the furnace controller is configured to:

deactivate the furnace system based on an additional determination that the call for heating is terminated;

determine a run cycle time of the furnace system based on termination of the call for heating; and replace the rolling average furnace run time of the furnace system with the run cycle time.

9. The furnace system of claim 1, wherein the furnace controller is configured to:

receive a first indication from a thermostat indicative of a call for heating and receive a second indication from the thermostat indicative of the call for heating being satisfied;

determine a run cycle time of the furnace system based on a time interval between the first indication and the second indication; and update the rolling average furnace run time based on the run cycle time.

10. The furnace system of claim 1, wherein the furnace controller is configured to determine the rolling average furnace run time based on a weighted average calculation.

11. The furnace system of claim 1, wherein the furnace controller is configured to adjust one or more gas valves of the furnace system based on the plurality of operational time periods to achieve the plurality of distinct fire rates associated with the plurality of operational time periods.

12. The furnace system of claim 1, wherein the furnace controller comprises a processor and a memory configured to store instructions, and wherein the processor is configured to execute the instructions stored on the memory.

13. A furnace controller for a furnace system, wherein the furnace controller is configured to:

initiate operation of a furnace system based on receipt of a call for heating;

determine that a communication link between the furnace controller and a sensor is severed; and based on determination of severance of the communication link, operate the furnace system in accordance with a segmented operational control scheme, wherein, to operate the furnace system in accordance with the segmented operational control scheme, the furnace controller is configured to:

segment a rolling average furnace run time of the furnace system into a plurality of operational time periods, wherein each operational time period is associated with a distinct fire rate of a plurality of distinct fire rates the furnace system; and operate the furnace system to sequentially implement the plurality of distinct fire rates associated with the plurality of operational time periods.

14. The furnace controller of claim 13, wherein the furnace controller is configured to determine the rolling average furnace run time based on a plurality of previous run cycles of the furnace system.

15. The furnace controller of claim 13, wherein the furnace controller is configured to determine that the communication link between the furnace controller and the sensor is severed based on a determination that the sensor is under a fault condition.

16. The furnace controller of claim 13, wherein, to operate the furnace system in accordance with the segmented operational control scheme, the furnace controller is configured to adjust one or more gas valve of the furnace system between a plurality of discrete positions.

17. A non-transitory, computer-readable medium comprising instructions that, when executed by a processor, are configured to cause the processor to:

determine a rolling average furnace run time of a furnace system based on a plurality of previous run cycles of the furnace system;

segment the rolling average furnace run time into a plurality of operational time periods corresponding to a plurality of distinct fire rates of the furnace system; and operate the furnace system to sequentially implement the plurality of distinct fire rates corresponding to the plurality of operational time periods.

18. The non-transitory, computer-readable medium of claim 17, wherein the instructions, when executed by the processor, are configured to cause the processor to:

determine whether a communication link between a sensor of the furnace system and the processor is severed; and operate the furnace system to sequentially implement the plurality of distinct fire rates based on determination that the communication link is severed.

19. The non-transitory, computer-readable medium of claim 17, wherein the instructions, when executed by the processor, are configured to cause the processor to:

determine a run cycle time of the furnace system based on a time interval between receipt of a first indication to initiate operation of the furnace system and a second signal to terminate operation of the furnace system; and update the rolling average furnace run time based on the run cycle time.

* * * * *